US006267026B1

(12) United States Patent
Yamamoto

(10) Patent No.: US 6,267,026 B1
(45) Date of Patent: Jul. 31, 2001

(54) SCREWDRIVER FOR SELF-DRILLING SCREW

(76) Inventor: Tozo Yamamoto, 6151 Beckett Station Ct., West Chester, OH (US) 45069

( * ) Notice: Subject to any disclaimer, the term of this patent is extended or adjusted under 35 U.S.C. 154(b) by 0 days.

(21) Appl. No.: 09/257,394

(22) Filed: Feb. 25, 1999

Related U.S. Application Data

(60) Provisional application No. 60/076,886, filed on Mar. 5, 1998.

(51) Int. Cl.[7] ..... B25B 21/00
(52) U.S. Cl. ..... 81/54; 29/798
(58) Field of Search ..... 81/54, 55; 29/798, 29/428, 429; 408/87, 99, 102

(56) References Cited

U.S. PATENT DOCUMENTS

| | | | |
|---|---|---|---|
| 55,696 | 6/1866 | Nevergold . | |
| 2,079,863 | 5/1937 | Koon . | |
| 2,261,746 | 11/1941 | Seaboly . | |
| 2,466,965 | 4/1949 | Pitts . | |
| 2,642,761 | 6/1953 | Goldberg . | |
| 3,250,153 | 5/1966 | Purkey . | |
| 4,679,969 | 7/1987 | Riley | 408/87 |
| 5,314,271 * | 5/1994 | Christiano | 408/87 |
| 5,352,070 | 10/1994 | Tehrani | 408/102 |

FOREIGN PATENT DOCUMENTS

| | | | |
|---|---|---|---|
| 3704202 | 5/1988 | (DE) | 81/52 |

OTHER PUBLICATIONS

Advertisement 1996 Hougen Manufacturing, Inc.

* cited by examiner

*Primary Examiner*—Joseph J. Hail, III
*Assistant Examiner*—David B Thomas
(74) *Attorney, Agent, or Firm*—Steven J. Rosen

(57) ABSTRACT

A hand-held power screwdriver with a clamping device is disclosed. The screwdriver includes a body, a screwing arm, a clamping arm, and a clamping device. The body is similar to an ordinary hand drill. A torque shaft, a part of the screwing arm, is connected to the body at one end, and it has a socket for a self-drilling screw at the other end. The clamping arm is movably connected to the body, and it has a clamping head at one end. The clamping device will clamp two or more members between the screw and the clamping head during the screw driving process.

17 Claims, 18 Drawing Sheets

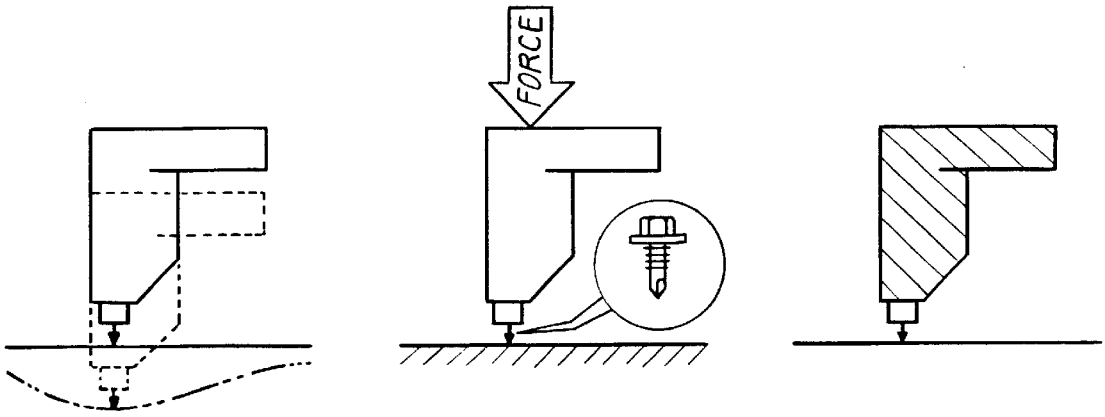
FIG. 1A FIG. 1B FIG. 1C
FIG. 1
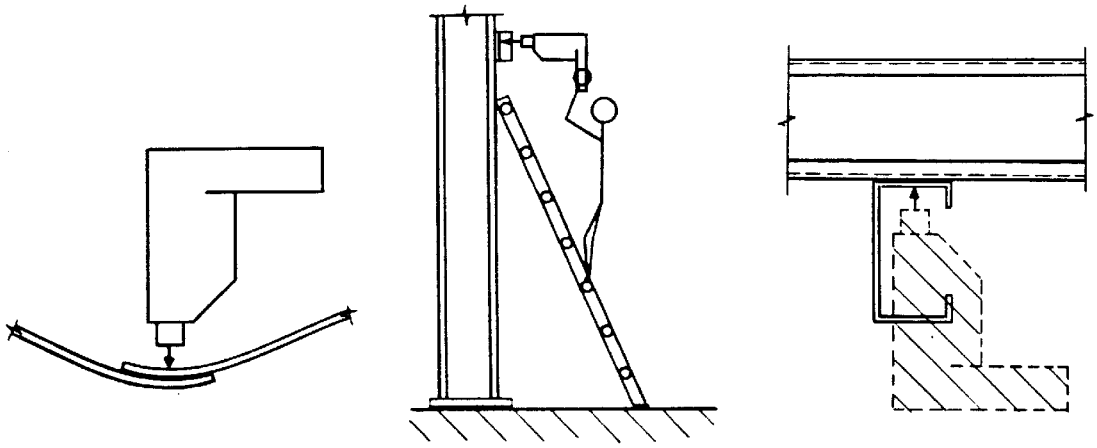
FIG. 2A FIG. 2B FIG. 2C
FIG. 2

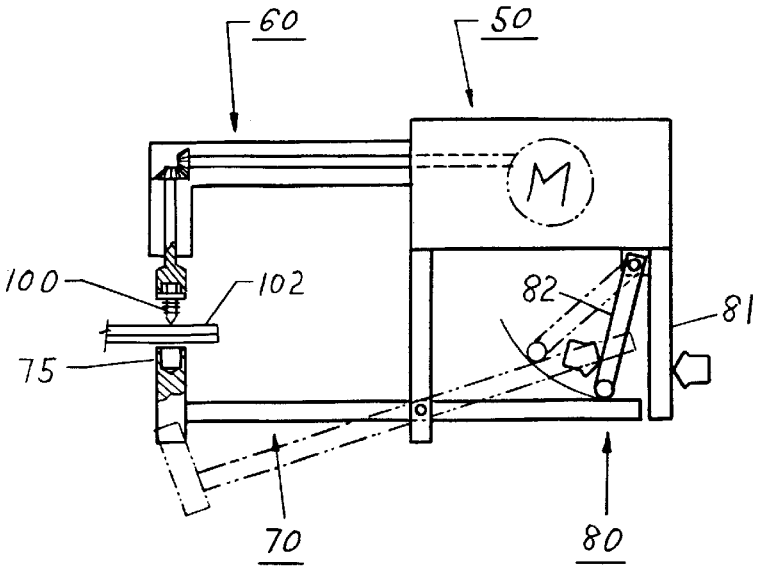
FIG. 3
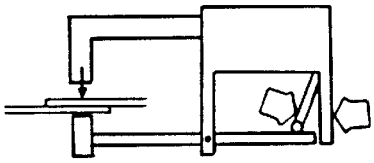
FIG. 4A
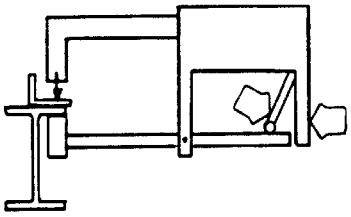
FIG. 4B
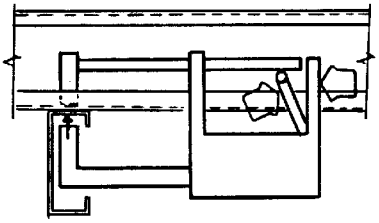
FIG. 4C
FIG. 4

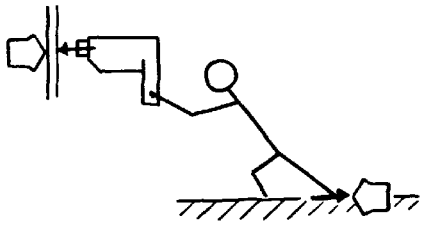
FIG. 5A
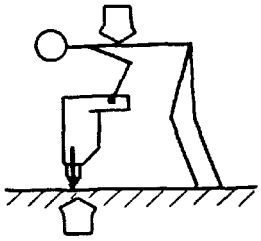
FIG. 5B
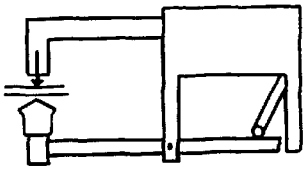
FIG. 5C
FIG. 5
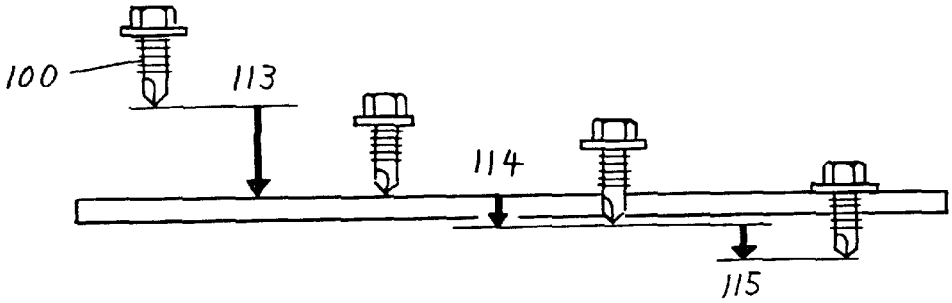
FIG. 6
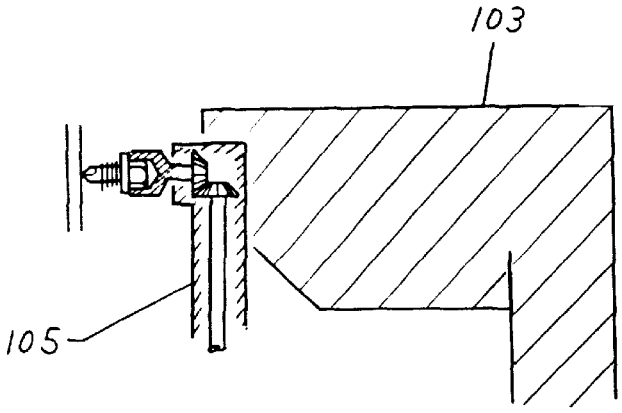
FIG. 7

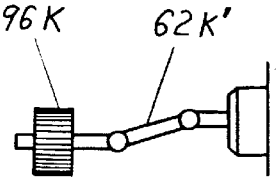
FIG. 18D
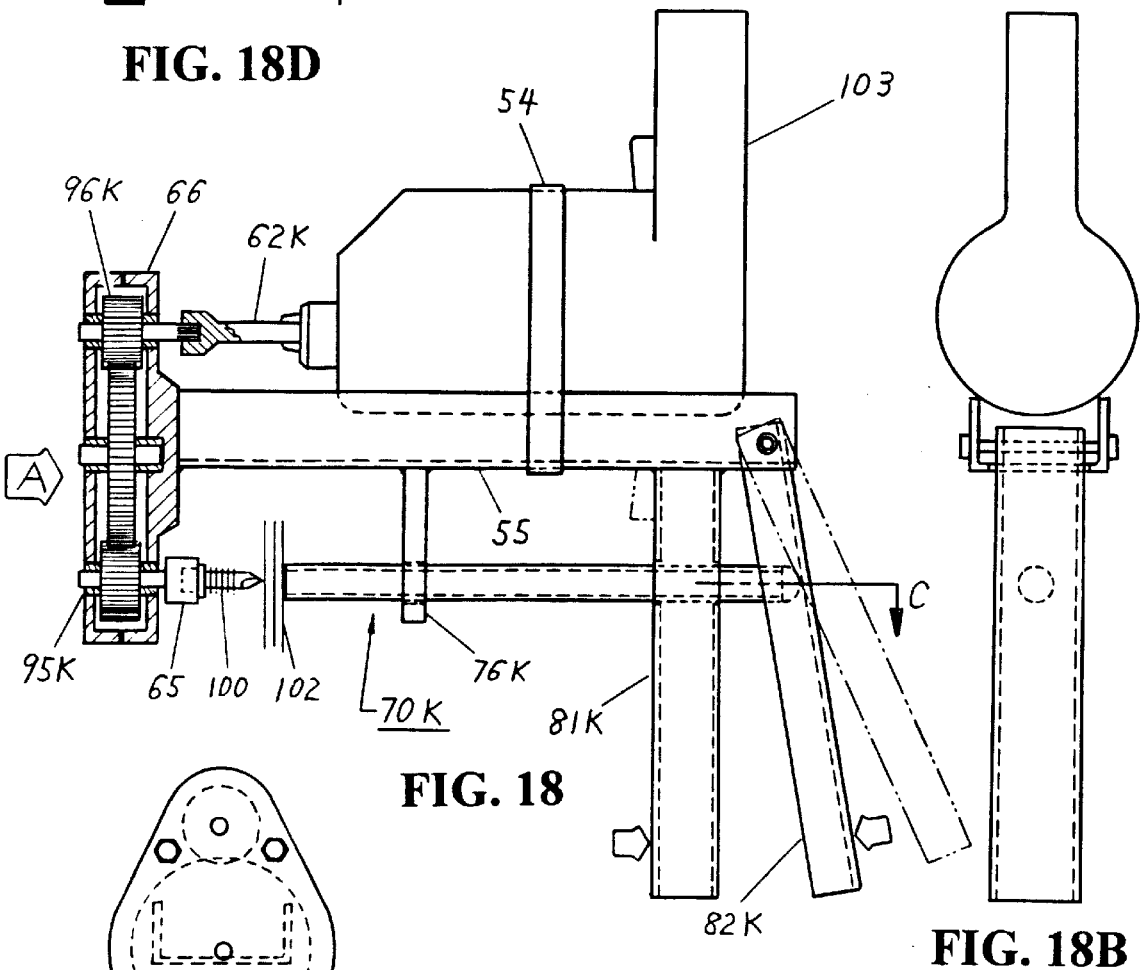
FIG. 18
FIG. 18B
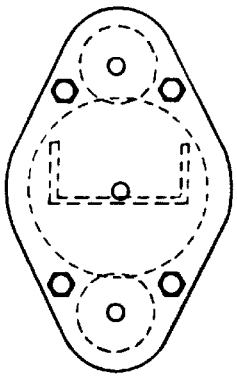
FIG. 18A
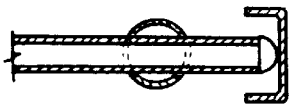
FIG. 18C

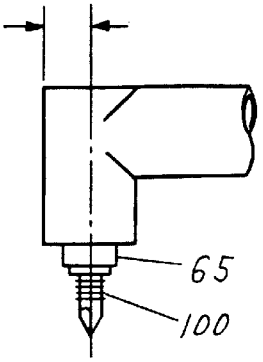
FIG. 19A
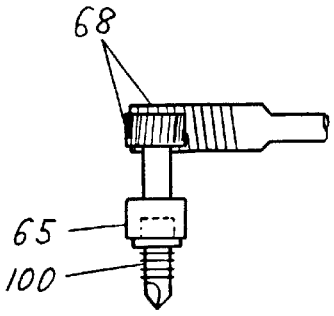
FIG. 19B
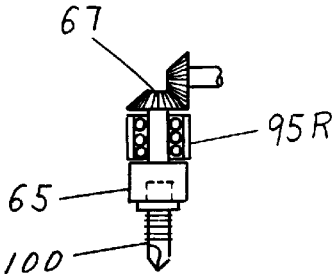
FIG. 19C
FIG. 19
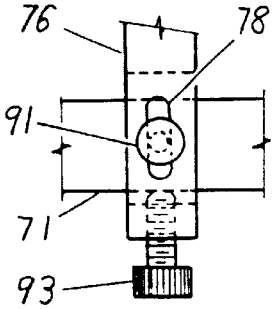
FIG. 20
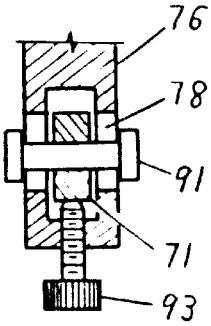
FIG. 20A
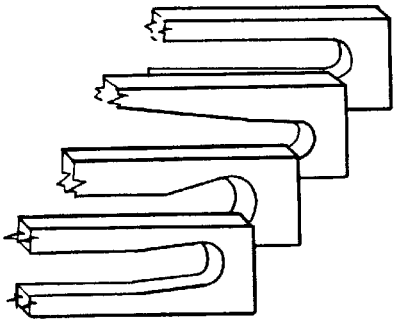
FIG. 21

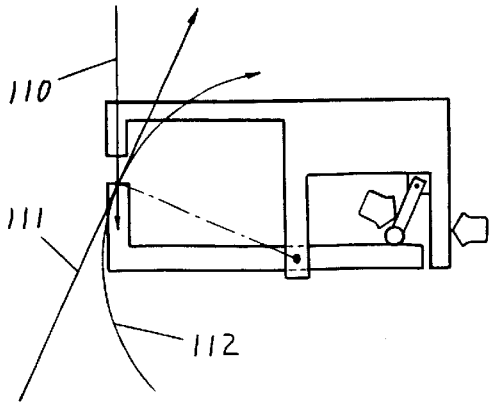
FIG. 26
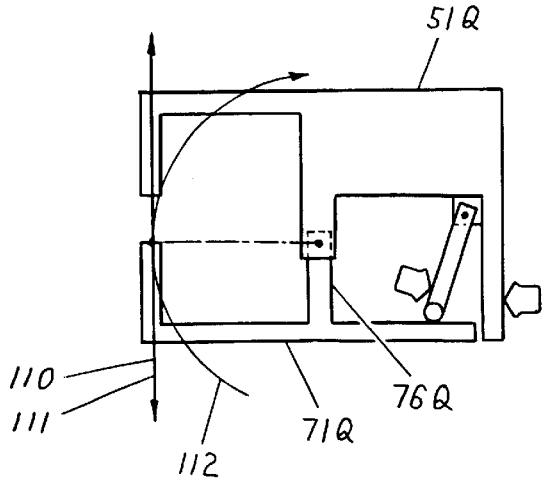
FIG. 27
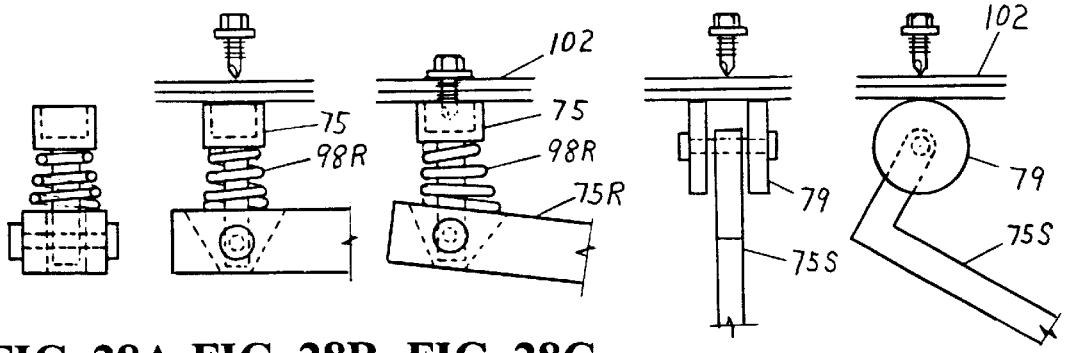
FIG. 28A FIG. 28B FIG. 28C FIG. 28D FIG. 28E
FIG. 28
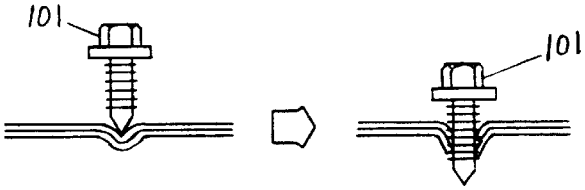
FIG. 29A FIG. 29B

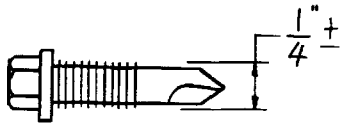
FIG. 30B
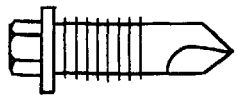
FIG. 30A
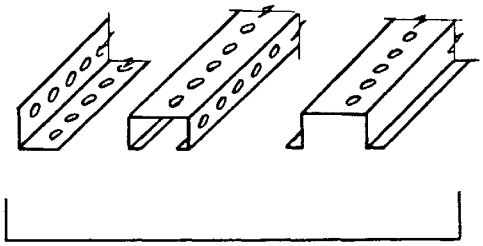
FIG. 31B
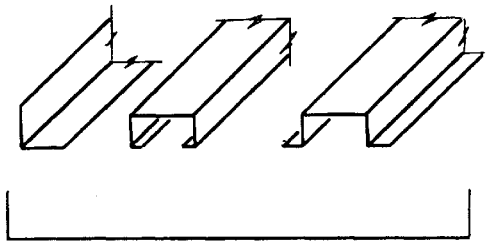
FIG. 31A
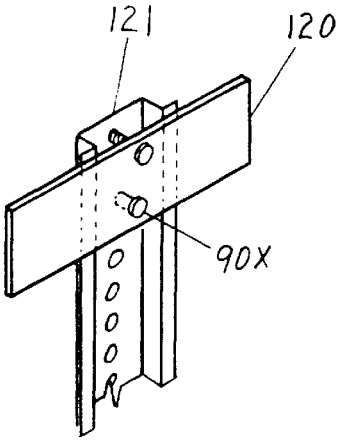
FIG. 32B1
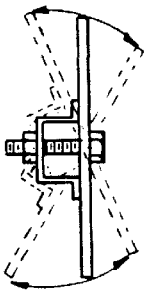
FIG. 32B2
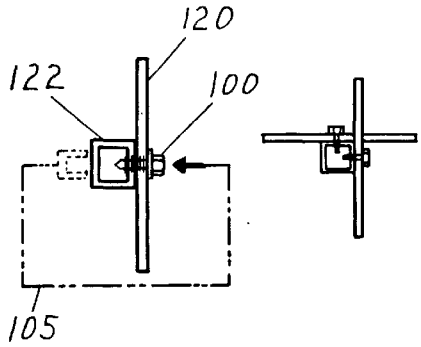
FIG. 32A2
FIG. 32A1

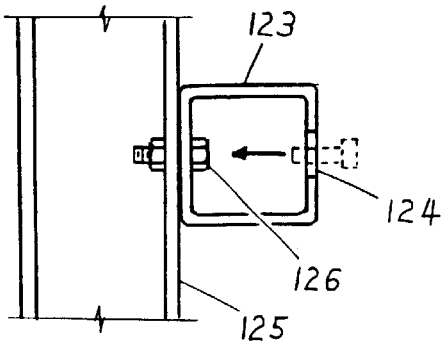
FIG. 33B
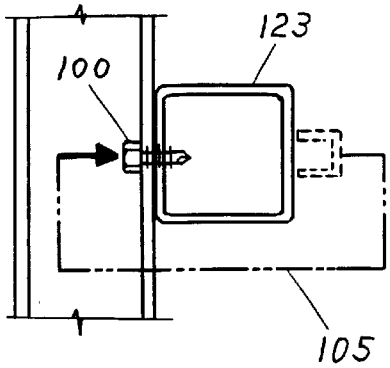
FIG. 33A
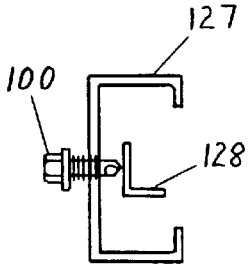
FIG. 34B1
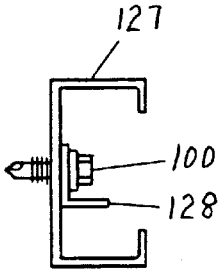
FIG. 34B2
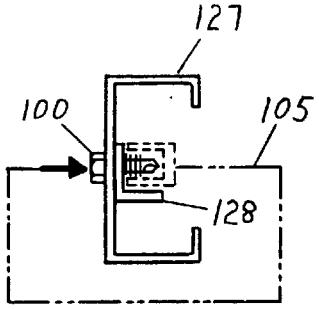
FIG. 34A
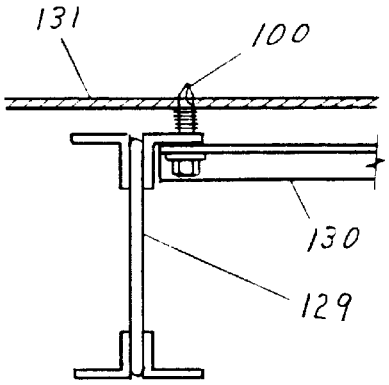
FIG. 35B
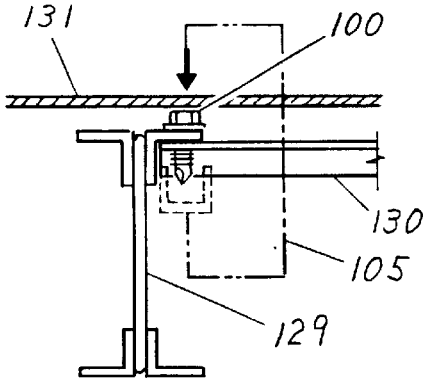
FIG. 35A

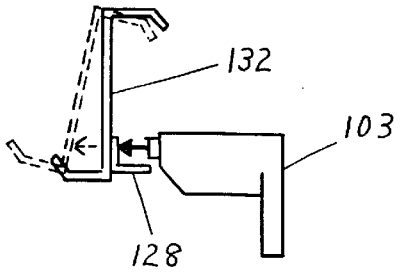
FIG. 36B
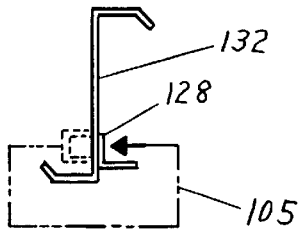
FIG. 36A
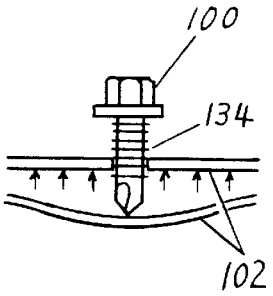
FIG. 37B1
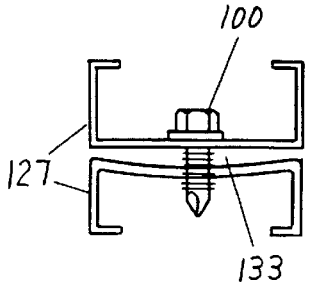
FIG. 37B2
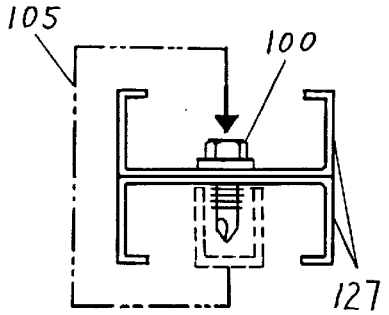
FIG. 37A
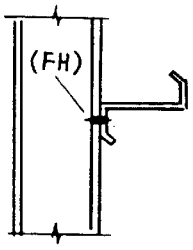
FIG. 38C
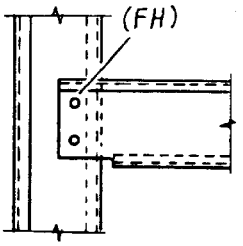
FIG. 38D
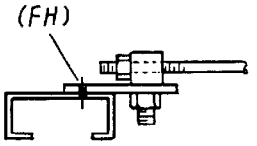
FIG. 38E
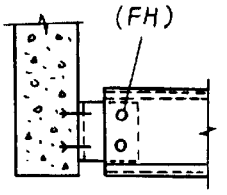
FIG 38F

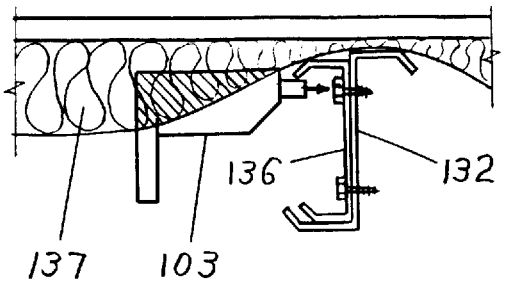
FIG. 39B
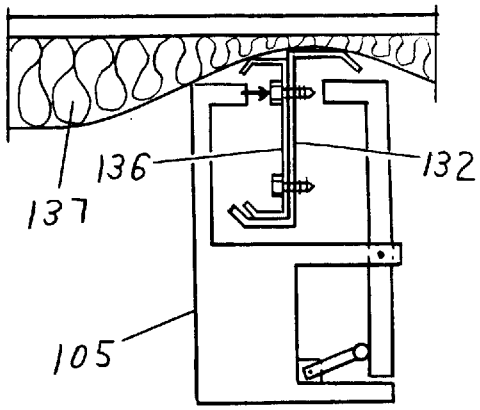
FIG. 39A
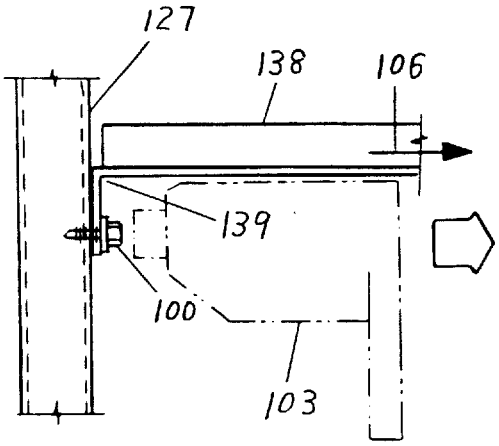
FIG. 40B1
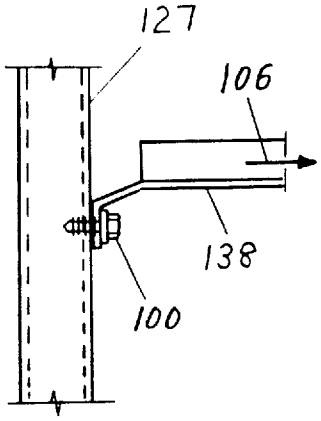
FIG. 40B2
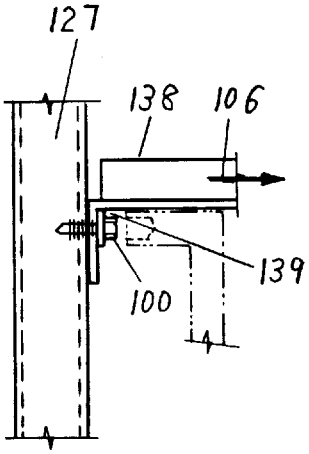
FIG. 40A

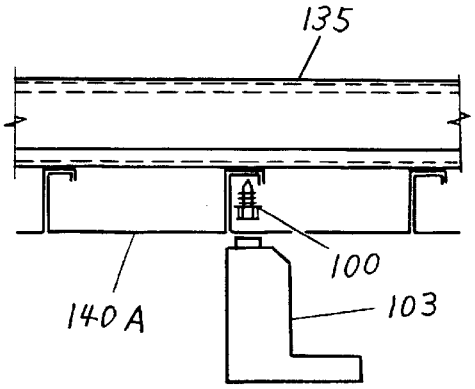
FIG. 41B1
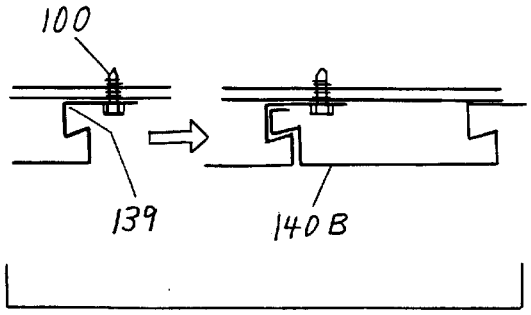
FIG. 41B2
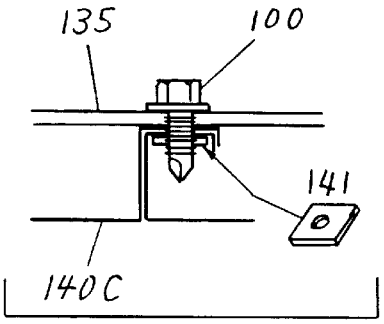
FIG. 41B3
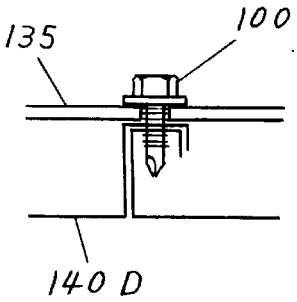
FIG. 41B4
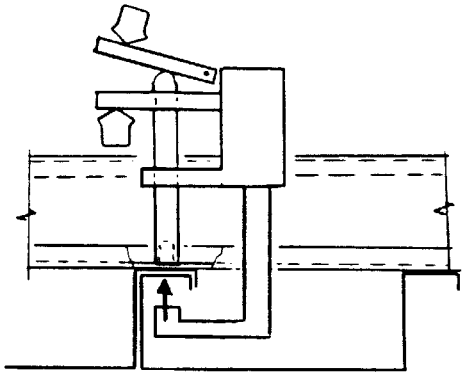
FIG. 41A1
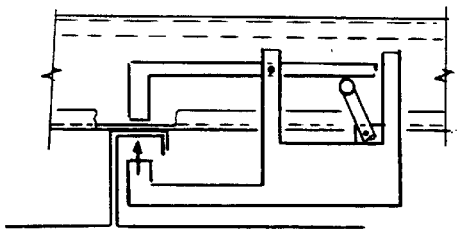
FIG. 41A2

SCREWDRIVER FOR SELF-DRILLING SCREW

CROSS-REFERENCE TO RELATED APPLICATIONS

Provisional Patent Application Application No.: 60/076886 Filing Date: Mar. 5, 1998

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to hand-held power screwdrivers.

In light gauge steel construction, an ordinary hand drill is used to drive a self-drilling screw. This practice creates many difficulties or limits to usage of self-drilling screws. These difficulties and limits are generally due to failure to satisfy one or more of three needs: support, force, and space. For example, members will move away if there is no support (FIG. 1A); need relatively large thrust force during drilling process (FIG. 1B); and need a clear space equal to size of a hand drill in front of a screwing surface (FIG. 1C).

More specifically, it is difficult to splice two thin plates with self-drilling screws—lack of support. (FIG. 2A) It is difficult to exert force, if you are on a ladder—lack of force.(FIG. 2B) And, it is difficult to attach metal studs to side of supporting structure—lack of space.(FIG. 2C)

My screwdriver (FIG. 3), comprising a body 50, a screwing arm 60, a clamping arm 70, and a clamping devise 80, is the solutions to the above three difficulties. My screwdriver clamps members 102 between a self-drilling screw 100 and clamping head 75 by hand gripping handle 81 and gripping lever 82. My screwdriver provides a rigid support to the two thin plates (FIG. 4A); my screwdriver provides a multiplied force, even if you are on a ladder (FIG. 4B); and my screwdriver does not require a large clear space in front of a screwing surface (FIG. 4C).

There are a few key points worth mentioning about my screwdriver. When an ordinary hand drill is used for screwing, the thrust force and the support are depended on external reactions and the gravitational force (weight), whereas, with my screwdriver both the thrust force and the support are within the same system. (FIG. 5A, 5B, and 5C)

Driving of a self-drilling screw 100 is three step processes: positioning 113, drilling 114, and screwing 115. A large thrust force is required only during the drilling process 114 that is generally short-distance (thickness of material) process. Multiplying the force for the short-distance is relatively easy task. (FIG. 6)

By bending the screwing arm, generally use of bevel gears and generally 90 degree, and by designing specifically for driving a screw, a screw can reach to "hard to reach" area. FIG. 7 shows the comparison of clear space requirements between an ordinary hand drill 103 and my screwdriver 105.

Several prior arts describe hand drills with clamping devises. They are U.S. Pat. Nos. 0,055,696 (1866) to Nevergold, 2,261,746 (1941) to Seaboly, 2,466,965 (1949) to Pitts, 2,642,761 (1953) to Goldberg, 3,250,153 (1966) to Purkey, 4,679,969 (1987) to Riley, 5,314,271 (1994) to Christiano, and 5,352,070 (1994) to Tehrani. However, these prior arts are for making holes, not for screwing, and they did not solve the difficulties and the limitations of using self-drilling screws as described here.

U.S. Pat. No. 2,079,863 (1937), to Koon describe screwing with clamp. However, this is not power screwdriver, and the screws used are for pre-threaded holes. And, this prior art did not solve the difficulties and the limitations of using self-drilling screws as described here.

BRIEF SUMMARY OF THE INVENTION

In light gauge steel construction, an ordinary hand drill is used to drive a self-drilling screw. However, members will move away if there is no rigid support (FIG. 2A); in some situation, it is difficult to exert relatively large thrust force needed (FIG. 2B); and need a clear space equal to size of a hand drill in front of a screwing surface (FIG. 2C).

My screwdriver (FIG. 3), comprising a body, a screwing arm, a clamping arm, and a clamping devise, is the solution to the above problems. My screwdriver provides a rigid support to the two thin plates (FIG. 4A); my screwdriver provides a multiplied force, even if you are on a ladder (FIG. 4B); and my screwdriver does not require a large clear space in front of a screwing surface (FIG. 4C).

BRIEF DESCRIPTION OF THE SEVERAL VIEWS OF THE DRAWING

For back ground:

FIG. 1: Shows self-drilling screw's three needs: support, force, and space.

FIG. 1A: Shows need of a rigid support.

FIG. 1B: Shows need of a relatively large thrust force.

FIG. 1C: Shows need of clear space, at least size of a hand drill, in front of screwing surface.

FIG. 2: Shows three examples of failure to satisfy the needs.

FIG. 2A: Shows how difficult to screw two plates together without a rigid support.

FIG. 2B: Shows how difficult to exert a large thrust force in some situation.

FIG. 2C: Shows how a hand drill interferes with some members.

FIG. 3: Shows general view of preferred embodiment.

FIG. 4: Shows solutions to the three problems shown in FIG. 2.

FIG. 4A: Shows my screwdriver provides a rigid support.

FIG. 4B: Shows my screwdriver provides a needed force.

FIG. 4C: Shows my screwdriver does not interfere with a metal stud.

FIG. 5: Shows that the thrust force and the rigid support are external for driving a screw with a hand drill, whereas they are internal with my screwdriver.

FIG. 5A: Shows that driving a screw with a hand drill needs a floor to push back (reaction) and a rigid structure which does not move away.

FIG. 5B: Shows that driving a screw with a hand drill needs a body to push (weight) and a rigid floor which does not move away.

FIG. 5C: Shows that driving a screw with my screwdriver does not need any external help.

FIG. 6: Shows process of driving a self-drilling screw: positioning, drilling, and screwing.

FIG. 7: Shows the comparison of clear space requirements between an ordinary hand drill and my screwdriver.

Figure 8:
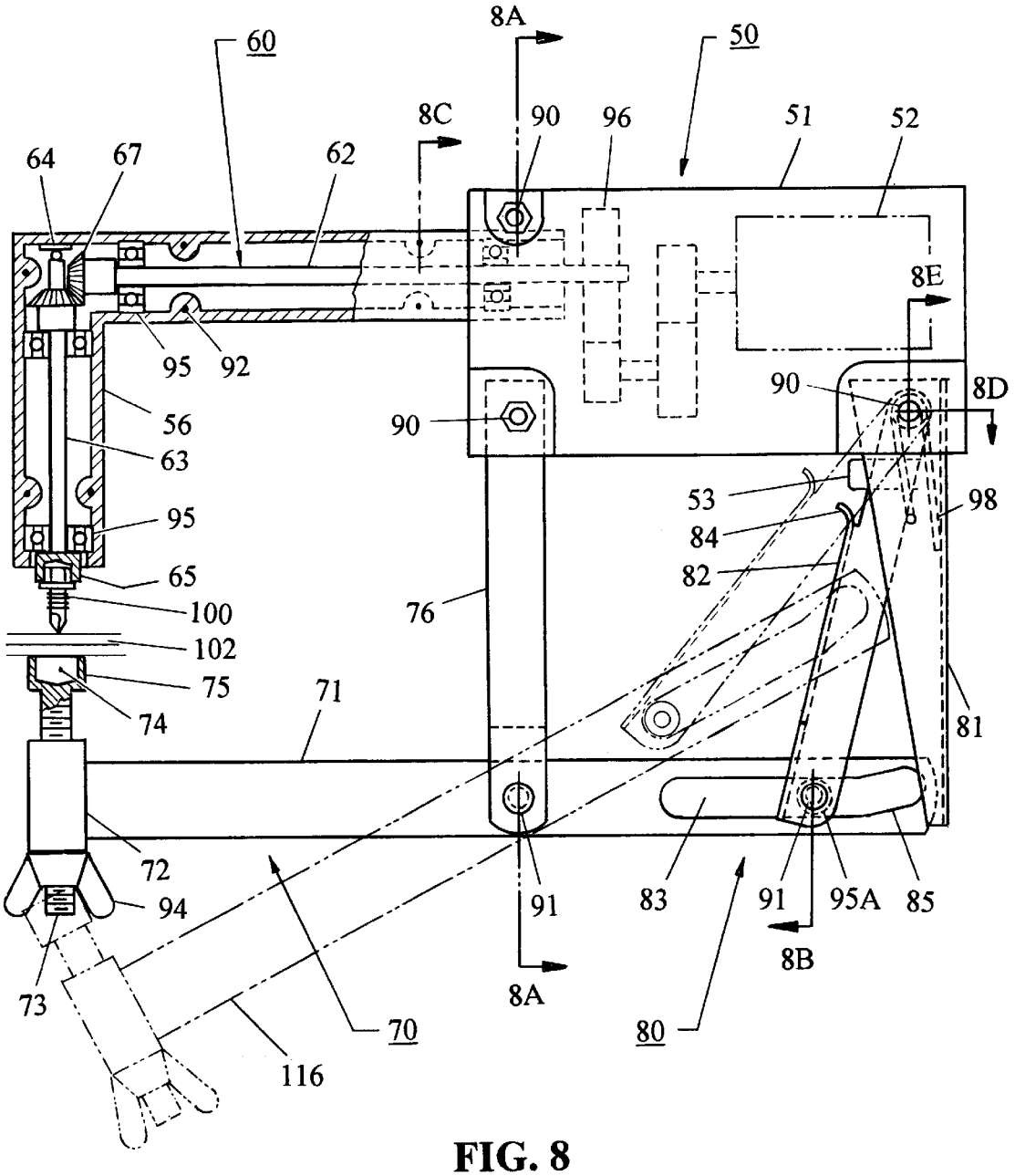

For embodiments:

FIG. 8: Preferred embodiment showing both closed position and open position.

Figure 8A:
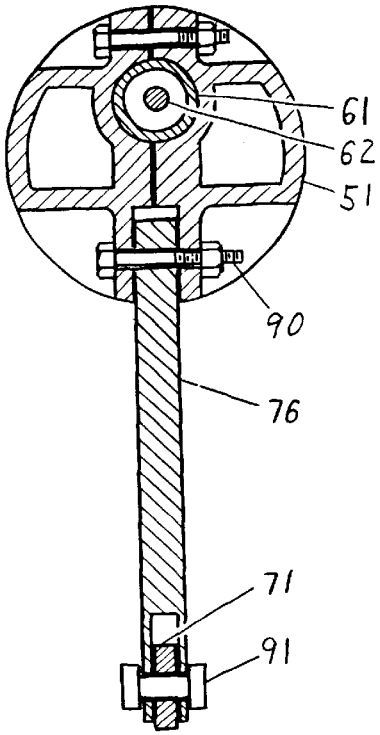

FIG. 8A: Cross-sectional view of the preferred embodiment taken along line A—A.

Figure 8B:
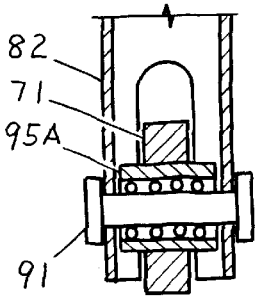

FIG. 8B: Cross-sectional view of the preferred embodiment taken along line B—B.

Figure 8C:
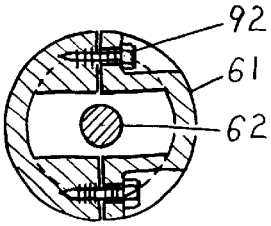

FIG. 8C: Cross-sectional view of the preferred embodiment taken along line C—C.

Figure 8D:
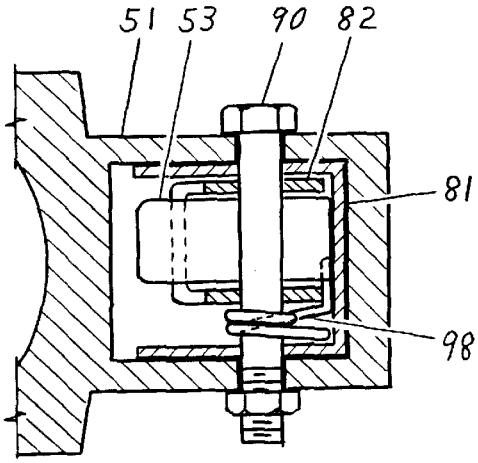

FIG. 8D: Cross-sectional view of the preferred embodiment taken along line D—D.

Figure 8E:
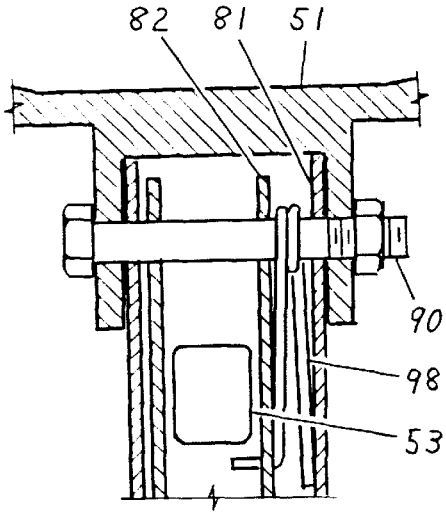

FIG. 8E: Cross-sectional view of the preferred embodiment taken along line E—E.

Figure 8F:
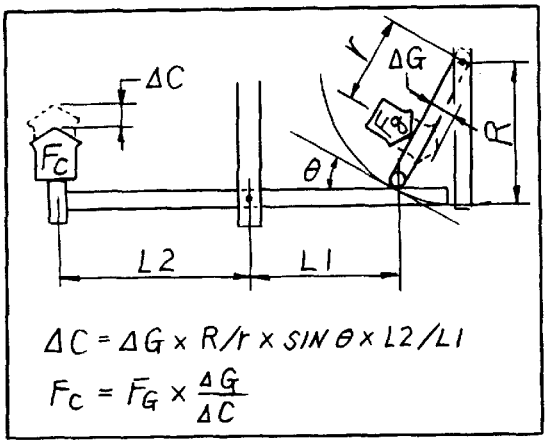

FIG. 8F: Mathematical explanation of force multiplication.

Figure 9:
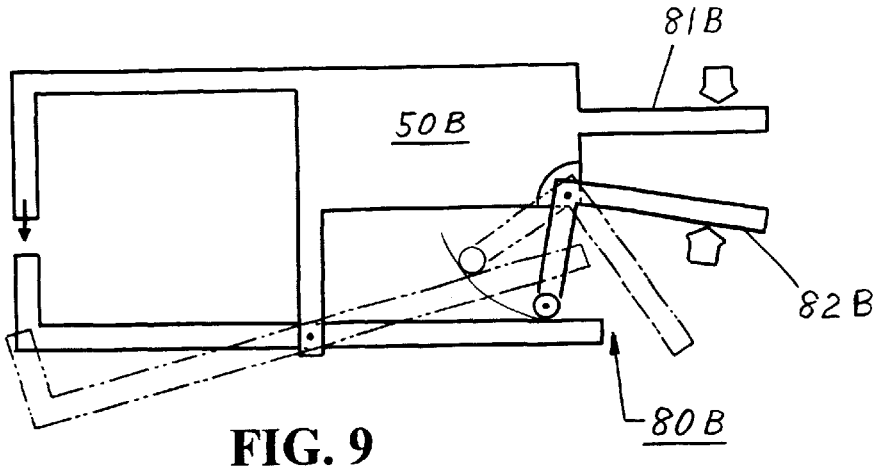

FIG. 9: Another embodiment: a handle is located at rear of the body.

Figure 10:
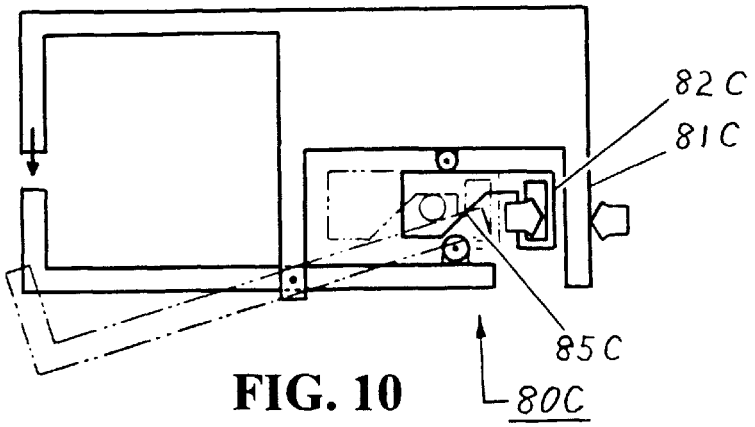

FIG. 10: Another embodiment: a gripping lever is sliding.

Figure 11:
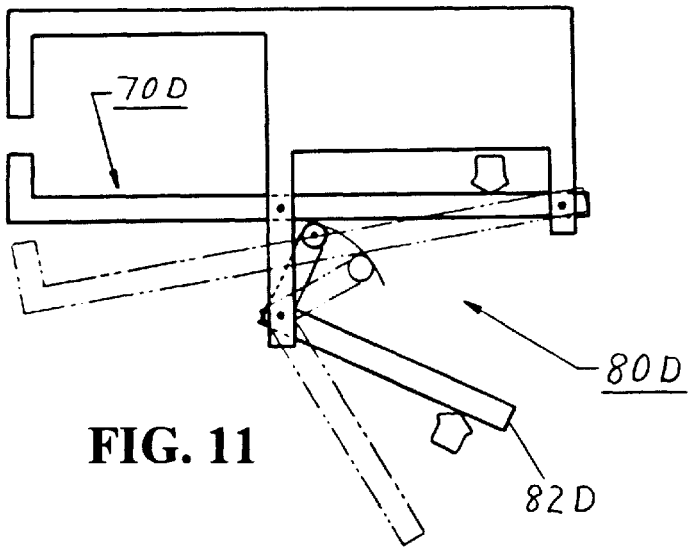

FIG. 11: Another embodiment: a gripping lever is located at below a clamping arm.

Figure 12:
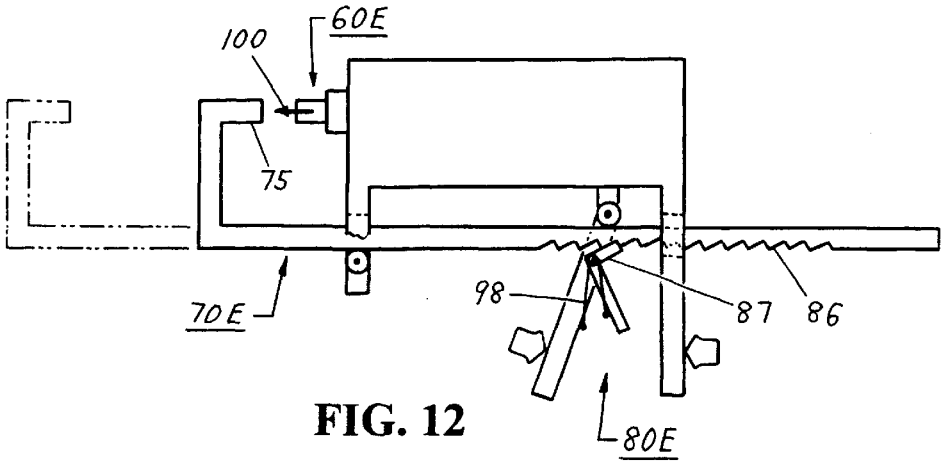

FIG. 12: Another embodiment: clamping arm is bent 180 degree, and have a large grip between a screw and a clamping head.

Figure 13:
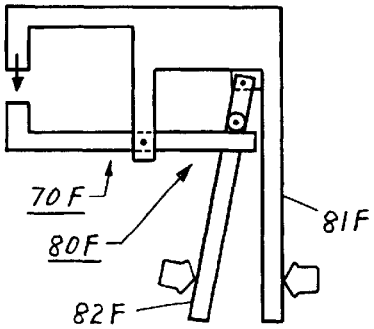

FIG. 13: Another embodiment: increased clamping force.

Figure 14:
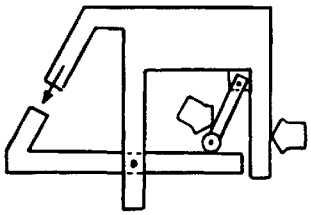

FIG. 14: Another embodiment: skewed angle clamping.

Figure 15:
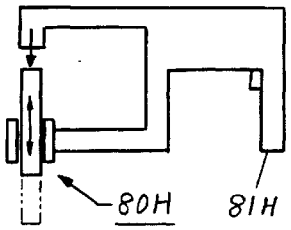

FIG. 15: Another embodiment: clamping force is powered.

Figure 16:
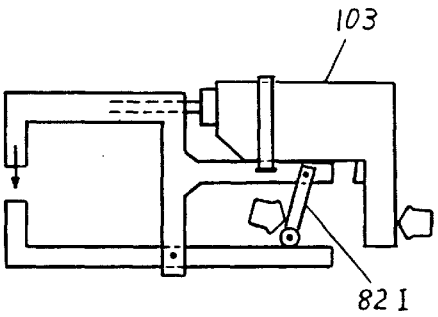

FIG. 16: Another embodiment: my screwdriver using an ordinary hand drill.

Figure 17:
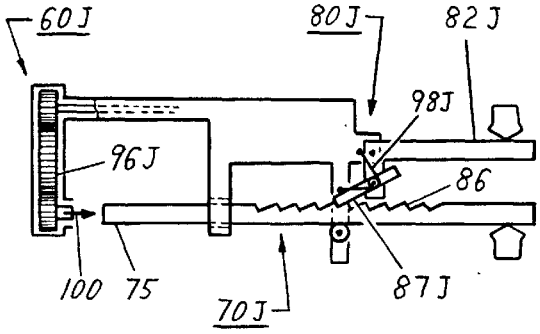

FIG. 17: Another embodiment: screwing arm is bent 180 degree and have large grip.

FIG. 18: Another embodiment: use of an ordinary hand drill.

FIG. 18A: Left view of FIG. 18.

FIG. 18B: Right view of FIG. 18.

FIG. 18C: Cross-sectional view of FIG. 18 taken along line C—C.

FIG. 18D: Alternative torque shaft to the shaft shown in FIG. 18.

FIG. 19: Shows how to minimize size of a screwing head.

FIG. 19A: Shows a dimension to be minimized.

FIG. 19B: Shows use of a worm and a worm gear.

FIG. 19C: Shows use of a bearing without an inner ring.

FIG. 20: Shows an alternative way of adjusting clamping head position.

FIG. 20A: Cross-sectional view of FIG. 20 taken along line A—A.

FIG. 21: Partial views of clamping levers having different clamping force arrangement.

Figure 22:
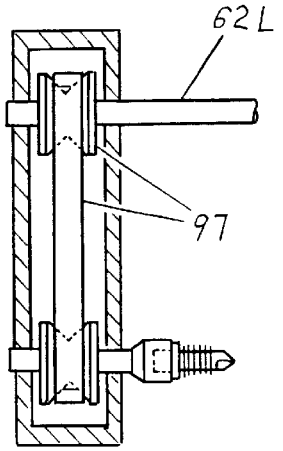

FIG. 22: Shows a belt and pulleys that replace gears shown in FIG. 17 and FIG. 18.

Figure 23:
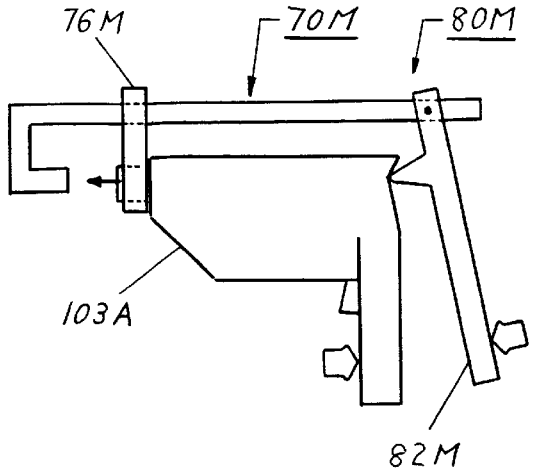

FIG. 23: Another embodiment: use of an ordinary hand drill with front housing collar.

Figure 24:
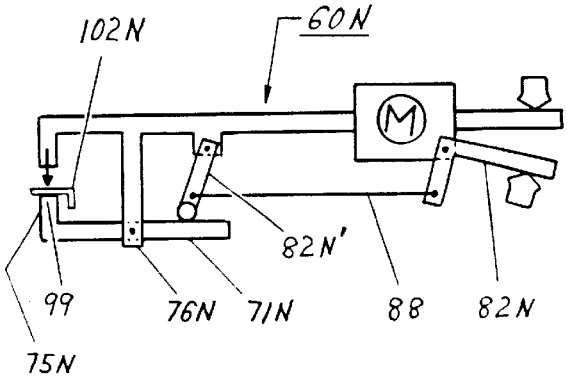

FIG. 24: Another embodiment: with long arms.

Figure 25:
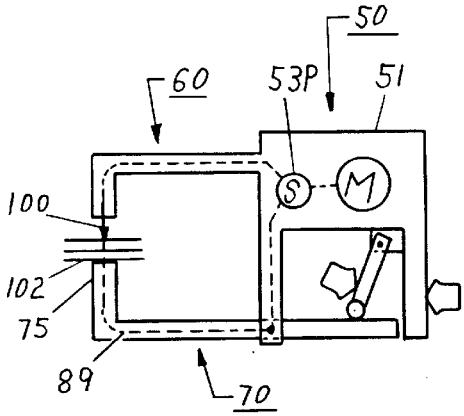

FIG. 25: Another embodiment: automatic trigger switching at clamping contact.

FIG. 26: Shows force directions of a screw and a clamping head.

FIG. 27: Another embodiment: force directions of a screw and clamping head are line up.

FIG. 28: Clamping head adjustments for misalignment between head and driving force.

FIG. 28A: Right end view of FIG. 28B.

FIG. 28B: Adjustment with a coil spring.

FIG. 28C: Adjustment with a coil spring.

FIG. 28D: Right end view of FIG. 28E.

FIG. 28E: Adjustment with rollers.

FIG. 29(A & B): Shows that a pointed-tip screw can be substituted for a self-drilling screw.

For ramifications:

FIG. 30B: Shows the largest size of a self-drilling screw that a hand drill can drive.

FIG. 30A: Shows the largest size of a self-drilling screw that my screwdriver can drive.

FIG. 31B: Members for shelf, post, hanger, etc. those have series of holes for bolt-connections.

FIG. 31A: Members for shelf, post, hanger, etc. those do not have any hole, witch can be used with my screwdriver.

FIG. 32B1: Shows a present street sign that have series of holes for bolt connections.

FIG. 32B2: Shows twisting street sign.

FIG. 32A1: A street sign attached to a tube, which is strong in torsion, is possible with my screwdriver using larger screw.

FIG. 32A2: Shows street signs at an intersection.

FIG. 33B: Shows present way of installing a tube member to another structural member.

FIG. 33A: Shows how to install a tube member to another structural member with my screwdriver.

FIG. 34B1: Shows a clip moves away from a hand drill.

FIG. 34B2: Shows hazardous condition.

FIG. 34A: Shows how a clip can be safely fastened with my screwdriver.

FIG. 35B: Shows a pointed tip of a screw is against roofing member.

FIG. 35A: Shows a pointed tip of a screw is away from roofing member when installed with my screwdriver.

FIG. 36B: Shows that a purlin moves away from a hand drill.

FIG. 36A: Shows that a purlin will not move away from my screwdriver.

FIG. 37B1: Shows that some member will spring back when drilling process is completed.

FIG. 37B2: Shows the result of the spring back.

FIG. 37A: Shows the same two members screwed with my screwdriver.

FIG. 38(C,D,E,& F): Shows where larger self-drilling screws may replace "field holes for bolt connection" by using my screwdriver.

FIG. 39B: Shows building insulation interfere with a hand drill.

FIG. 39A: Shows building insulation will not interfere with my screwdriver.

FIG. 40B1: Shows a screw can not be fastened right next to bent corner with a hand drill.

FIG. 40B2: Shows a connected member stretched-out when a screw is away from bent comer.

FIG. 40A: Shows a connected member will not stretched-out when a screw is at bent comer.

FIG. 41B1: Shows that concealed- fastener type wall panels cannot be screwed to a girt from panel side with a hand drill.

FIG. 41B(2,3,& 4): Shows how some wall panel manufacturers try to overcome the problem.

FIG. 41A(1 & 2): Shows how concealed-fastener type wall panels are screwed with my screwdriver.

Figure 42B:
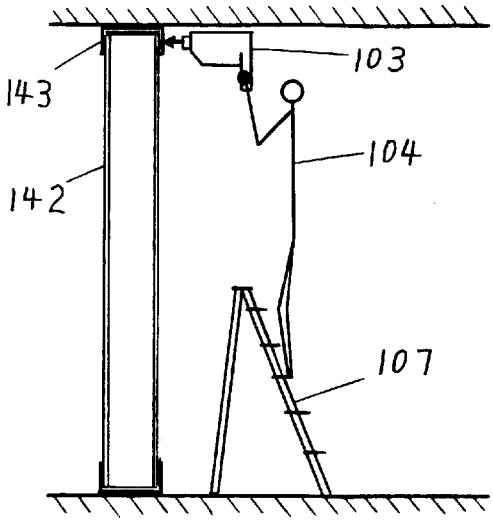

FIG. 42B: Shows how metal stud partition walls are constructed with a hand drill.

Figure 42A:
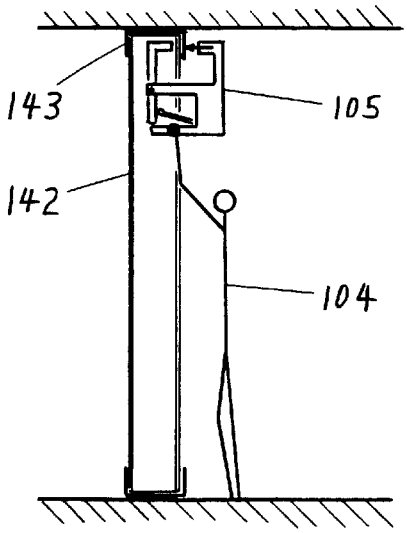

FIG. 42A: Shows how metal stud partition walls are constructed with my screwdriver.

Figure 43B:
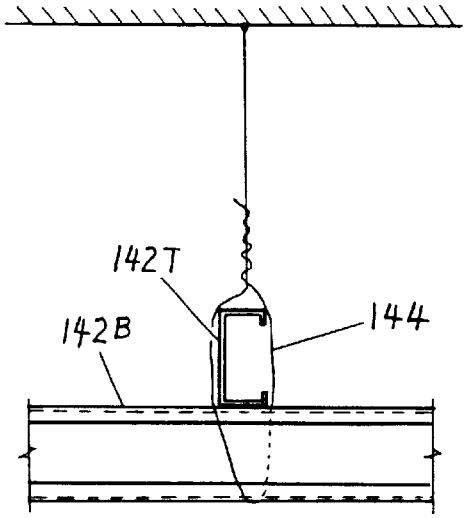

FIG. 43B: Shows how metal stud ceilings are constructed without my screwdriver.

Figure 43A:
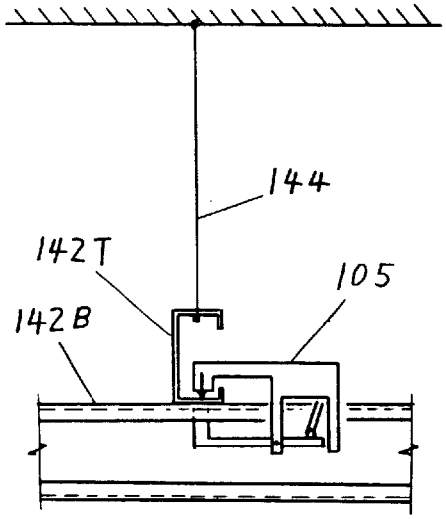

FIG. 43A: Shows how metal stud ceilings are constructed with my screwdriver.

Figure 44B:
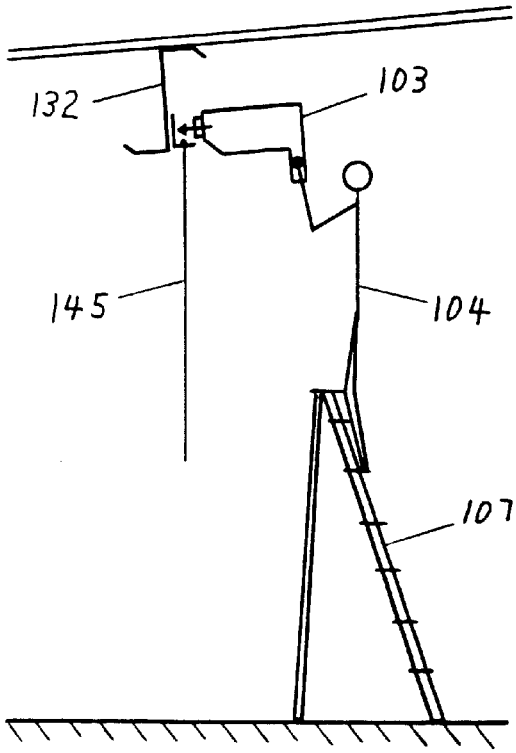

FIG. 44B: Shows how a hanging wire is fastened to a purlin with a hand drill.

Figure 44A:
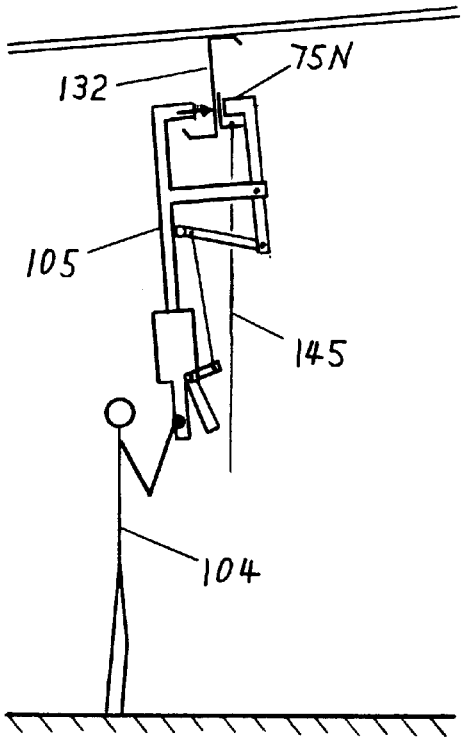

FIG. 44A: Shows how a hanging wire is fastened to a purlin with my screwdriver.

Figure 45B:
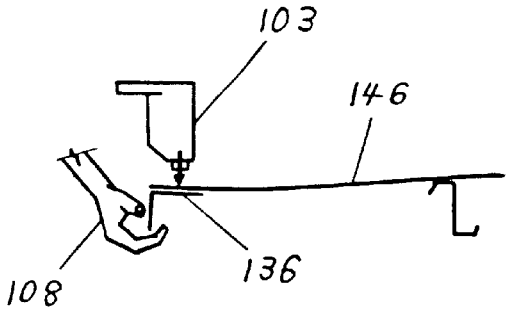

FIG. 45B: Shows how to fasten sheet metal to a reinforcing member with a hand drill.

Figure 45A:
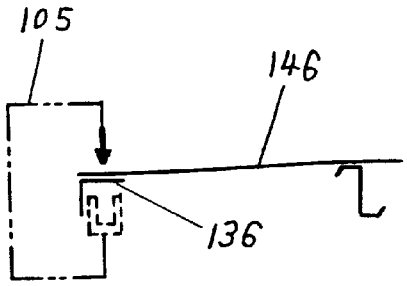

FIG. 45A: Shows how to fasten sheet metal to a reinforcing member with my screwdriver.

| Reference Numerals in Drawings | |
|---|---|
| 50 | Body |
| 51 | Housing |
| 52 | Motor |
| 53 | Trigger |
| 54 | Strap |
| 55 | Frame |
| 60 | Screwing Arm |
| 61 | Shaft Housing |
| 62 | Upper Torque Shaft |
| 63 | Lower Torque Shaft |
| 64 | Steel Ball and Steel Plate |
| 65 | Socket |
| 66 | Gear Housing |
| 67 | Bevel Gear |
| 68 | Worm and Worm Gear |
| 70 | Clamping Arm |
| 71 | Clamping Lever |
| 72 | Clamping Screw Holder |
| 73 | Clamping Screw |
| 74 | Pocket |
| 75 | Clamping Head |
| 76 | Link |
| 78 | Adjustment Slot |
| 79 | Roller |
| 80 | Clamping Device |
| 81 | Handle |
| 82 | Gripping Lever |
| 83 | Slot |
| 84 | Finger Stop |
| 85 | Ramp |
| 86 | Toothed Surface |
| 87 | Pawl |
| 88 | Rod |
| 89 | Electric Current |
| 90 | Bolt and Nut |
| 91 | Pin |
| 92 | Self-Tapping Screw |
| 93 | Set Screw |
| 94 | Wing Nut |
| 95 | Bearing |
| 96 | Gear(s) |
| 97 | Belt and Pulleys |
| 98 | Spring |
| 99 | Magnet |
| 100 | Self-Drilling Screw |
| 101 | Pointed-Tip Screw |
| 102 | Member(s) to be screwed together |
| 103 | Ordinary Hand Drill |
| 104 | Worker |
| 105 | My Screwdriver |
| 106 | Force |
| 107 | Ladder |

-continued

| Reference Numerals in Drawings | |
|---|---|
| 108 | Hand |
| 110 | Force Direction of Screw |
| 111 | Force Direction of Clamping Head |
| 112 | Circular Line |
| 113 | Positioning Process |
| 114 | Drilling Process |
| 115 | Screwing Process |
| 116 | Open Position |
| 120 | Street Sign |
| 121 | Hat-Shaped Section |
| 122 | Tube Post |
| 123 | Tube Member |
| 124 | Access Hole |
| 125 | Structural Member |
| 126 | Bolt |
| 127 | Channel Member |
| 128 | Clip |
| 129 | Bar Joist |
| 130 | Angle Member |
| 131 | Roofing |
| 132 | Purlin |
| 133 | Gap |
| 134 | Screw Thread |
| 135 | Girt |
| 136 | Reinforcing Member |
| 137 | Insulation |
| 138 | Angle Member with Bent Tab |
| 139 | Bent Corner |
| 140 | Wall Panel |
| 141 | Washer with pilot hole |
| 142 | Metal Studs |
| 143 | Runner |
| 144 | Wire |
| 145 | Hanging Wire |
| 146 | Sheet Metal |

DETAILED DESCRIPTION OF THE INVENTION

Preferred Embodiment:

FIG. 8 shows an overall view of the preferred embodiment of the invention. The screwdriver includes a body 50, a screwing arm 60, a clamping arm 70, and a clamping device 80. Body 50 is similar to an ordinary hand drill. A set of torque shafts 62 and 63, a part of screwing arm 60, is connected to body 50 at one end, and it has a screw socket 65 for a self-drilling screw 100 at the other end. Clamping arm 70 is movably connected to body 50, and it has a clamping head 75 at the end. Clamping device 80 enables self-drilling screw 100 and clamping head 75 to clamp two or more members 102 during the driving process.

Body 50 includes a hosing 51 to encase a motor 52 and a set of reducing gears 96. A trigger 53, which is located at bottom of body 50 and at top of a gripping lever 82, will start and stop motor 52. FIG. 8A shows how shaft housing 61 and a link 76 are rigidly attached to housing 51 with sets of bolt and nut 90. FIG. 8D and 8E show how a handle 81 is rigidly attached to housing 51 with a set of bolt and nut 90.

Screwing arm 60 includes shaft housing 61 to encase torque shaft 62 and torque shaft 63. Torque shafts 62 and 63 are rotatably supported by shaft housing 61 via shaft bearings 95. Torque shaft 62 is rigidly connected to the last gear of reducing gears 96 at one end, and at the other end it is rotatably linked to torque shaft 63 via bevel gears 67. At the other end of torque shaft 63, there is screw socket 65 that magnetically holds self-drilling screw 100. A steel ball and a plate 64 rotatably support the clamping force that comes from self-drilling screw 100 via torque shaft 63. Shaft housing 61 is made of two-piece formed material and self-tapping screws 66 will fasten them together as shown in FIG. 8C.

Clamping arm 70 includes a clamping lever 71, link 76, and clamping head 75. Link 76, which is rigidly connected to housing 51 at one end, pivotably supports clamping lever 71 via a pin 91 at the other end. Clamping lever 71 pivotably supported at center by link 76 have a clamping screw holder 72 attached at one end, and it have a clamping slot 83 at the other end for clamping devise. Clamping screw holder 72 at the end of clamping lever 71 adjustably holds a clamping screw 73. Clamping head 75 is located at the end of clamping screw 73, and it contains pocket 74 to provide a clearance for the tip of self-drilling screw 100. A wing nut 94, located next to clamping screw holder 72, fixes the position of clamping head 75.

Clamping device 80 includes handle 81, a gripping lever 82, and slot 83. FIG. 8D and FIG. 8E show how bolt and nut 90 pivotably connect gripping lever 82 and rigidly connect handle 81 to housing 51. And bolt and nut 90 also pivotally support spring 98 that returns clamping arm 80 to the open position. FIG. 8B shows how the other end of gripping lever 82 is slidably connected to slot 83 via a sliding bearing 95A and pin 91. A finger stop 84 prevents a finger from touching trigger 53 unintentionally during the positioning process. A ramp 85 is for the screwing process of driving self-drilling screw 100, where a large thrust force is no longer required.

FIG. 8F explains mathematically how the multiplication of thrust force works. For ideal system, which is frictionless system, energy input (gripping, $Fg \times \Delta G$) equal energy output (clamping, $Fc \times \Delta C$). Therefore, the multiplication factor, which is clamping force (Fc) over gripping force (Fg), is the rate of griping movement ($\Delta G$) over the rate of clamping movement ($\Delta C$).

Operation of the screwdriver is generally as followed. First, with left hand (for right-handed person), position said members 102 together so that generally thin and flat portions of said members 102 are placed together. Second, with right hand gripping handle 81 and gripping lever 82, clamp said members 102 between said screw 100 and said clamping head 75. Third, with right index finger pushing trigger 53, rotate said screw 100 while applying clamping force. Fourth, advance said screw 100 until the screw head tightly seated on the face of said flat portion. Whereby said members 102 will be tightly screwed together.

Other Embodiments

FIG. 9 shows another embodiment of the invention. Handle 81B and gripping lever 82B of clamping device 80B are located at the rear of body 50B, so that the gripping action moved to the rear of body 50B from the below.

FIG. 10 shows another embodiment of the invention. A gripping lever 82C is sliding movement in stead of pivoted movement, so that gripping lever 82C is parallel to handle 81C throughout the driving process. The clamping force multiplication factor is controlled by ramp 85C of clamping device 80C.

FIG. 11 shows another embodiment of the invention. Gripping lever 82D of clamping device 80D is located below clamping arm 70D, and clamping arm 70D, replacing handle 81, functions as handle. The direction of the gripping force is 90 degree rotated from the preferred embodiment.

FIG. 12 shows another embodiment of the invention. A short and straight screwing arm 60E holds self-drilling screw 100. A clamping arm 70E is bent 180 degree and has sliding movement. Clamping device 80E, which includes toothed surface 86, a pawl 87, and a spring 98, has ratchet action. A large grip can be achieved between screw 100 and clamping head 75.

FIG. 13 shows another embodiment of the invention. Clamping device 80F has a long handle 81F and a long gripping lever 82F, and the gripping action is located below clamping arm 70F. Therefore, an increased clamping force is achieved.

FIG. 14 shows another embodiment of the invention. Direction of clamping force is at skewed angle, so that the screwdriver can be positioned at skewed angle.

FIG. 15 shows another embodiment of the invention. Clamping force is powered; so that clamping device 80H does not require a gripping force at handle 81H.

FIG. 16 shows another embodiment of the invention. An ordinary hand drill 103 will replace body 50 and handle 81 of the preferred embodiment. The gripping action is between the handle of drill 103 and gripping lever 82l.

FIG. 17 shows another embodiment of the invention. A screwing arm 60J is bent 180 degree using gears 96J. A clamping arm 70J is straight and has sliding movement. Clamping device 80J, which includes toothed surface 86, a gripping lever 82J, a pawl 87J, and spring 98J, has ratchet action. A large grip can be achieved between screw 100 and clamping head 75.

FIG. 18, 18A, 18B, 18C, and 18D show another embodiment of the invention. This version of the screwdriver uses an ordinary hand drill 103. Hand drill 103 is detachably connected to a frame 55 via a strap 54. Gear housing 66 that hold gears 96K via bearings 95K is rigidly connected to one end of frame 55. Gears 96K transmit rotational energy from hand drill 103 to screw 100 via a shaft 62K and socket 65. A clamping arm 70K is slidably connected to a link 76K and a handle 81K. A gripping lever 82K, which is pivotably connected to frame 55, pushes one end of clamping arm 70K to clamp members 102 with screw 100. FIG. 18D shows a flexible torque shaft 62K' that substitute shaft 62K for alignment.

FIG. 19 shows how to minimize size of a screwing head. Worm and worm gear 68 (FIG. 19B) or bearings without inner ring 95R (FIG. 19C) may be used in order to minimize the dimension shown in FIG. 19A.

FIG. 20 shows an alternative way of adjusting position of clamping head 75 relative to screw 100 of the preferred embodiment (FIG. 8). The position can be adjusted at link 76 with adjustment slots 78 and a set screw 93.

FIG. 21 shows partial views of clamping levers 71 showing different clamping force arrangements—varying the multiplication factor.

FIG. 22 shows another embodiment of the invention that is same as the one shown in FIG. 17 and FIG. 18, except replacing gears 96J and 96K with a belt 97.

FIG. 23 shows another embodiment of the invention that uses an ordinary hand drill with a front housing collar 103A. Link 76M is detachably connected at the collar of hand drill 103A. A clamping arm 70M is slidably connected to link 76M. A gripping lever 82M is pivotably connected clamping arm 70M, and touched to the rear of hand drill 103A during the driving process.

FIG. 24 shows another embodiment of the invention that has a long screwing arm 60N. A link 76N is rigidly connected to long screwing arm 60N, and pivotably supports a clamping arm 71N. A gripping lever 82N' is pivotably connected to screwing arm 60N and connected to a gripping arm 82N via a rod 88. So, this version of the screwdriver can reach to high place. If a clamping head 75N has a magnet 99 or it is magnetized, clamping head 75N can temporally hold small part 102N.

FIG. 25 shows another embodiment of the invention. This version of the screwdriver has a trigger 53P inside of housing 51 next to a motor 52. When clamping arm 70 is closed electric current 89 flow through body 50, screwing arm 60, screw 100, members 102, clamping head 75, and clamping arm 70; and turn on trigger 53P to start motor 52 and the drilling process. When clamping arm is opened, current 89 stops and turns off trigger 53P. In another word, on-off switching of said motor 52 is done by contact of screw 100 and clamping head 75 via members 102.

FIG. 26 illustrates directions of clamping forces. For some embodiments, force directions of screw 110 and clamping head 111, which is tangent of circular line 112, are not lined-up. Normally this misalignment does not cause operational problem.

FIG. 27 shows one solution to this misalignment. A link 76Q is rigidly connected to clamping lever 71Q and pivotably connected to housing 51Q, so that the force directions of screw 110 and clamping head 111, which is tangent of line 112, are lined-up.

FIG. 28(A through E) show clamping heads with self-adjustments for the misalignment. FIG. 28A shows that clamping head 75 is aligned at the beginning of drilling process. But, at the end of screwing process, due to circular motion of clamping arm 75R, clamping force is not aligned with driving force any more. Still, clamping head 75 is, because of spring 98R, flush with members 102. By using rollers 79 for a clamping head, clamping force is always perpendicular to members 102 no matter what position clamping arm 75S is.

FIG. 29A shows that a pointed-tip screw such as a self-tapping screw 101 is piecing a hole in light gauge metal. FIG. 29B shows that screw 101 is tapping over the pieced hole.

RAMIFICATIONS

For following FIGS. 30 through 45, subscript "B" denotes Before the invention and subscript "A" denotes After the invention.

FIG. 30B shows the largest self-drilling screw (¼") normally found in the market. To drive a self-drilling screw requires relatively large thrust force; the screw size is limited by how much force a typical worker can comfortably exert. As the result, in typical situation, self-drilling screws can not replace bolted connections.

FIG. 30A shows a larger self-drilling screw that can be driven with my screwdriver using the multiplied force. With my screwdriver, in many situations, self-drilling screws can replace ⅜" and ½" bolted connections.

FIG. 31B shows some members with series of pre-punched holes. These members are used for shelves, posts, hangers, etc., and those pre-punched holes are for bolted connections.

FIG. 31A shows same size members without pre-punched holes. With my screwdriver, these members can be used for shelves, posts, hangers, etc. using larger-size self-drilling. screws.

FIG. 32B1 shows a street sign 120 connected to a hat-shaped section post 121 with bolt and nut 90X. Hat-shaped section post 121 is most commonly used for a street sign. However, hat-shaped section is weak in torsion. Therefore, in windy day, twisting street signs are often observed as shown in FIG. 32B2.

FIG. 32A1 shows a street sign 120 connected to a tube post 122 with larger self-drilling screws 100 using my screwdriver 105. Tube, even lighter section, is strong in torsion. Using tube post 122 is economical and looked better, too. With tube post 122, street signs at intersection can be made nicely as shown in FIG. 32A2.

FIG. 33B shows that an access hole 124 is needed in order to install a tube member 123 to other structural member 125 with a bolt 126.

FIG. 33A shows that tube member 123 can be installed with a larger self-drilling screw 100 by using my screwdriver.

FIG. 34B I shows that a clip 128 will move away if you try to fasten them from the side of channel member 127. FIG. 34B2 shows that screw 100 could be hazardous if you fasten them from the side of clip 128.

FIG. 34A shows that with my screwdriver you can fasten them from the side of channel member 127 and the result is not hazardous.

FIG. 35B shows that if angle members 130 are fastened to top chord of bar joists 129, tip of screw 100 may damage roofing 131, which is to be installed later.

FIG. 35A shows that with my screwdriver angle member 130 can be installed without damaging roofing 131.

FIG. 36B shows that a purlin 132 may move away when you try to fasten clip 128 to it. Purlin 132 may not be rigid during construction when roof panels are not installed yet.

FIG. 36A shows that with my screwdriver 105 you can fasten clip 128 to purlin 132 even if it is not rigid.

FIG. 37B1 shows that a top member 102 will spring back to original position and start to catch screw thread when the drilling process is completed. FIG. 37B2 shows the result of the above phenomenon—a gap 133 between two channel members 127.

FIG. 37A shows that with my screwdriver 105 two channel-members 127 can be fastened together without gap 133.

FIG. 38(C,D,E,& F) shows where, marked (FH), larger self-drilling screws may replace "field holes for bolted connection". In metal building construction, phrase "field holes for bolted connection" is frequently used for non-standard condition or changed condition where normal factory punched holes are not available. For connecting a girt to a column (FIG. 38C), connecting a girt to a girt (FIG. 38D), connecting a wind brace to a channel column (FIG. 38D), and girt connection at masonry wall (FIG. 38E); driving a self-drilling screw is much easier than making a hole and install a bolt.

FIG. 39B shows that insulation 137 interferes with hand drill 103 when a reinforcement member 136 is to be fastened to an existing purlin 132.

FIG. 39A shows that my screwdriver 105 can fasten reinforcement member 136 to existing purlin 132 without interfering insulation 137.

FIG. 40B1 shows angle member with bent tab 138 is fastened to channel member 127 with screw 100. Note that screw 100 is away from bent comer 139 when ordinary hand drill 103 is used. FIG. 40B2 shows that when angle member 138 is pulled away from channel member 127, tab portion of angle member 138 will be stretched out.

FIG. 40A shows that with my screwdriver, screw 100 can be fasten to right next to bent comer 139. Therefore, tab portion of angle member 138 will not be stretched out.

FIG. 41B1 shows that concealed-fastener type wall panels 140A cannot be screwed to a girt 135 from outside (panel side) with hand drill 103. Many wall panel manufacturers try to overcome the above mentioned problem, and came up with some methods. Wall panel 140B shown in FIG. 41B2 can be screwed from outside, but this requires complicated wall panel and has a weak point—distance between bent comer 139 and screw 100 is too long. Wall panel 140C shown in FIG. 41B3 requires a washer with a pilot hole 141. While driving screw 100 with one hand, the other hand has to hold washer 141. This is not easy installation of wall panel. Wall panel 140D shown in FIG. 41B4 requires girt 135 with series of pre-punched holes. Pre-punching becomes very complicated for a building with non-standard dimension.

FIG. 41A1 and 41A2 shows how concealed-fastener type wall panels are screwed with my screwdriver.

FIG. 42B shows metal studs construction of partition wall, which is normally 8 feet to 10 feet tall. In order to fasten metal studs 142 to top runner 143 worker 104 has to step on a ladder 107 to screw with hand drill 103. Worker 104 has to carry step 107 with him along the wall, and he has to step up and down every time he moves.

FIG. 42A shows that with my screwdriver 105, preferred embodiment or version shown in FIG. 24, worker 104 can fasten metal studs 142 to top runner 143 without climbing a ladder. He just walks along the wall without a ladder.

FIG. 43B shows metal studs construction of suspended ceiling. First, series of metal studs 102T are hanged from structure above, and then another series of metal studs 102B are installed perpendicularly to the first series of metal studs by winding with wire 144.

FIG. 43A shows that with my screwdriver two series of metal studs 142T and 142B can be easily fastened.

FIG. 44B shows that a worker 104 on ladder 107 is fastening a hanging wire 145 to purlin 132 with hand drill 103.

FIG. 44A shows that with my screwdriver shown in FIG. 24 worker 104 can fasten hanging wire 145 without a ladder. Clamping head 75N of embodiment shown in FIG. 24 is magnetized, so that it can temporally hold hanging wire 145.

FIG. 45B shows that reinforcing member 136 is to be fastened to sheet metal 146 with hand drill 103. Hand 108 supports reinforcing member 136 during the fastening process.

FIG. 45A shows that with my screwdriver 105 reinforcing member 136 can be fastened to sheet metal 146 without need of external support.

Various modifications and changes may be made in the specific details of the illustrated structure without departing from the spirit and scope of the present invention as set forth in the following claims.

What is claimed is:

1. A method for joining two or more members together with a hand-held screwdriver powered by a motor, said method comprising the steps of:

(a) positioning said members together so that flat portions of said members are placed together, (b) clamping said members between a self-drilling screw mounted in said hand-held screwdriver and a clamping head attached to the screwdriver, and (c) drilling through said thin and flat portions of said members with said screw while applying a clamping force to said thin and flat portions of said members with said screw and said clamping head and advancing said screw with said clamping force until a screw head of said screw is tightly seated on a face of said flat portion.

2. The method of claim 1 wherein said clamping force is powered.

3. The method of claim 1 wherein said method is used in light gauge steel construction.

4. The method of claim 1 wherein said clamping head is self-adjusted for misalignment of clamping forces.

5. The method of claim 1 wherein said pointed-tip screw is a self-drilling screw.

6. The method of claim 5 wherein the clamping force is multiplied during drilling process.

7. The method of claim 1 wherein rotation of said screw is by a motor.

8. The method of claim 7 wherein on-off switching of said motor is done by contact of said screw and said clamping head via said members.

9. The method as claimed in claim 1 wherein step (b) further comprises positioning said members between the screw and the clamping head such that at least a portion of one of the members is positioned between parallel screwing and clamping arms of the hand-held screwdriver wherein the clamping head is mounted on the clamping arm.

10. The method as claimed in claim 9 wherein said step (b) further comprises adjusting the clamping head against one of the members with a clamping screw received inside of a clamping screw holder mounted on the clamping arm.

11. The method as claimed in claim 10 wherein step (b) further comprises fixing the clamping head with respect to the clamping screw holder the clamping arm by tightening a nut on the clamping screw against the clamping screw holder.

12. The method as claimed in claim 11 wherein said applying a clamping force in said step (c) further comprises manually squeezing a gripping lever towards a gripping handle wherein the gripping lever is operably linked to the clamping handle and the gripping handle is fixedly connected to the screw driver.

13. The method as claimed in claim 9 wherein said applying a clamping force in said step (c) further comprises applying a powered clamping force.

14. The method as claimed in claim 1 wherein said step (b) further comprises adjusting the clamping head against one of the members with a clamping screw received inside of a clamping screw holder mounted on the clamping arm.

15. The method as claimed in claim 14 wherein step (b) further comprises fixing the clamping head with respect to the clamping screw holder the clamping arm by tightening a nut on the clamping screw against the clamping screw holder.

16. The method as claimed in claim 15 wherein said applying a clamping force in said step (c) further comprises manually squeezing a gripping lever towards a gripping handle wherein the gripping lever is operably linked to the clamping handle and the gripping handle is fixedly connected to the screw driver.

17. The method as claimed in claim 14 wherein said applying a clamping force in said step (c) further comprises applying a powered clamping force.

* * * * *